US007425671B2

(12) United States Patent
Cupit

(10) Patent No.: US 7,425,671 B2
(45) Date of Patent: Sep. 16, 2008

(54) COMPACT STRINGED MUSICAL INSTRUMENT

(76) Inventor: Jerry Dean Cupit, P.O. Box 121904, Nashville, TN (US) 37212

( * ) Notice: Subject to any disclaimer, the term of this patent is extended or adjusted under 35 U.S.C. 154(b) by 0 days.

(21) Appl. No.: 11/000,666

(22) Filed: Dec. 1, 2004

(65) Prior Publication Data

US 2006/0112807 A1 Jun. 1, 2006

(51) Int. Cl.
*G10D 3/02* (2006.01)

(52) U.S. Cl. ..... 84/294; 84/173

(58) Field of Classification Search ..... 84/294, 84/173, 308, 290; D17/14
See application file for complete search history.

(56) References Cited

U.S. PATENT DOCUMENTS

| | | | | | |
|---|---|---|---|---|---|
| D50,545 | S | * | 3/1917 | Vaughn | D17/19 |
| 1,410,504 | A | * | 3/1922 | Post | 84/173 |
| 4,573,391 | A | | 3/1986 | White | |
| 4,576,080 | A | | 3/1986 | McLellan et al. | |
| 4,606,255 | A | * | 8/1986 | Hayashi et al. | 84/644 |
| 4,616,550 | A | * | 10/1986 | Lacroix et al. | 84/173 |
| 4,686,882 | A | | 8/1987 | Shaw | |
| D293,117 | S | | 12/1987 | Rose | |
| D363,080 | S | | 10/1995 | Smith | |
| D372,041 | S | | 7/1996 | Reizenstein | |
| 6,194,644 | B1 | | 2/2001 | Hendrickson | |
| 6,525,246 | B1 | | 2/2003 | Erisman | |
| 6,667,431 | B1 | * | 12/2003 | Norman | 84/290 |
| 6,693,233 | B1 | | 2/2004 | Sewell | |
| 2002/0162442 | A1 | * | 11/2002 | Bryan | 84/291 |
| 2005/0155480 | A1 | * | 7/2005 | Joseph | 84/299 |

* cited by examiner

*Primary Examiner*—Lincoln Donovan
*Assistant Examiner*—Jianchun Qin
(74) *Attorney, Agent, or Firm*—David D. Winters

(57) ABSTRACT

A compact stringed musical instrument with sound chamber, neck, and strings, having a folded configuration, the neck being extended back over the sound chamber body much after the fashion of a swan's neck reaching back over its torso.

13 Claims, 2 Drawing Sheets

COMPACT STRINGED MUSICAL INSTRUMENT

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of musical instruments and more specifically to a compact stringed musical instrument.

Guitar and other fingered or chorded stringed instruments have, thus far, exclusively been configured with the strings located almost entirely over the sound box or over a neck axially co-located, lengthwise, on an axis of the sound box.

Instruments with their strings positioned entirely over the sound box are almost impossible to finger chords upon. The dimensions of the sound chamber are necessarily too great to allow a normal human hand to fit around it. Without the ability to grip the instrument on front and back, fingering and chording with the finger-tips becomes difficult.

Fingering and chording have been facilitated by adding a neck to one end of the instrument, but this also inconveniently increases the dimensions of the instrument, easily doubling its length. This added length makes the instrument more difficult to transport. It also makes it harder to play by increasing the reach required to touch both the strumming area over the sound chamber, and the chording or fingering area on the neck.

The herein-taught technology defeats the above shortcomings by a configuration that provides both compact size, and convenient playing characteristics plus pleasant tonal qualities.

BRIEF SUMMARY OF THE INVENTION

The primary object of the invention is provide a stringed instrument that is compact to transport, even fitting in the overhead rack of an aircraft or in a backpack.

Another object of the invention is be easy to play due to center of neck and center of sound-chamber being near each other.

Another object of the invention is to have easily reached tuning pegs.

A further object of the invention is create a pleasant, and original sound.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a compact stringed musical instrument comprising: Sound chamber, Neck, and Strings.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

LIST OF NUMBERED COMPONENTS

Figure 2:
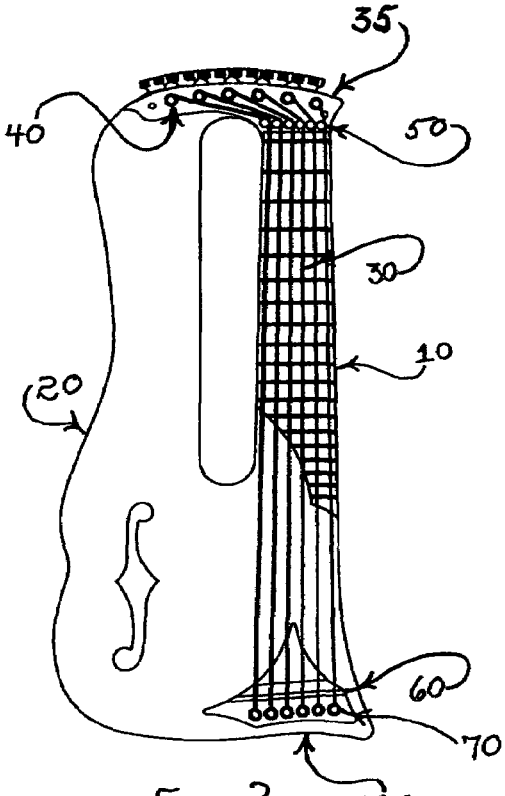
FIG. 2 is a face plan view
Figure 3:
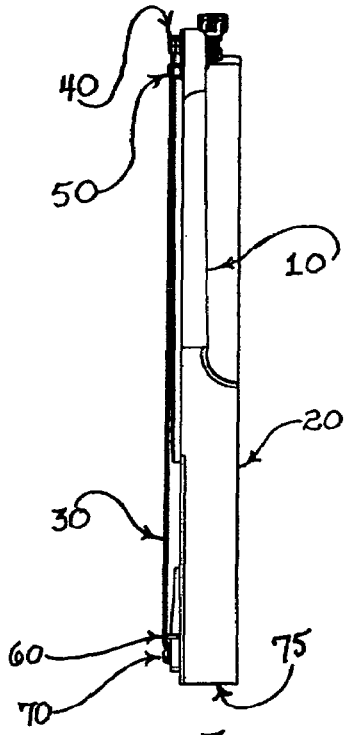
FIG. 3 is a side plan view
Figure 1:
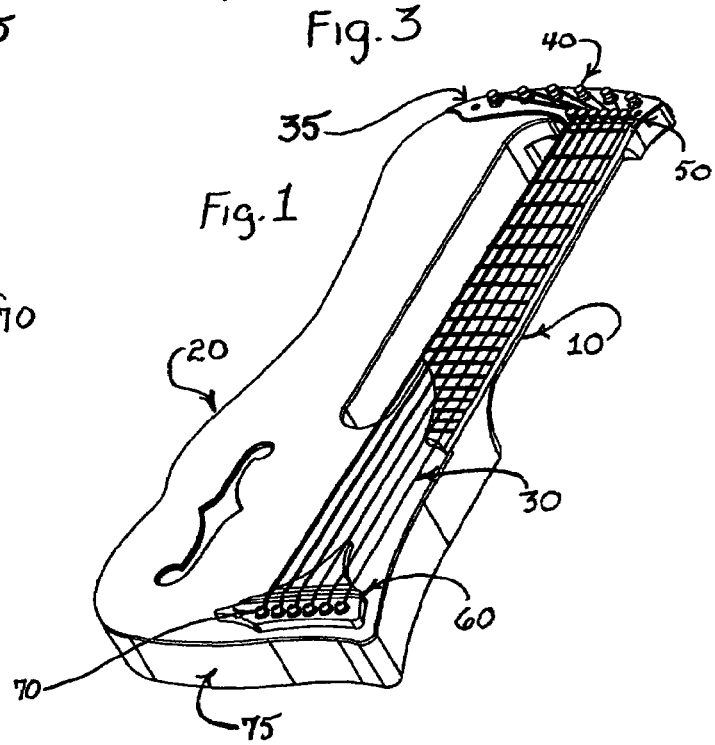
FIG. 1 is a perspective view of the instrument
Figure 5:
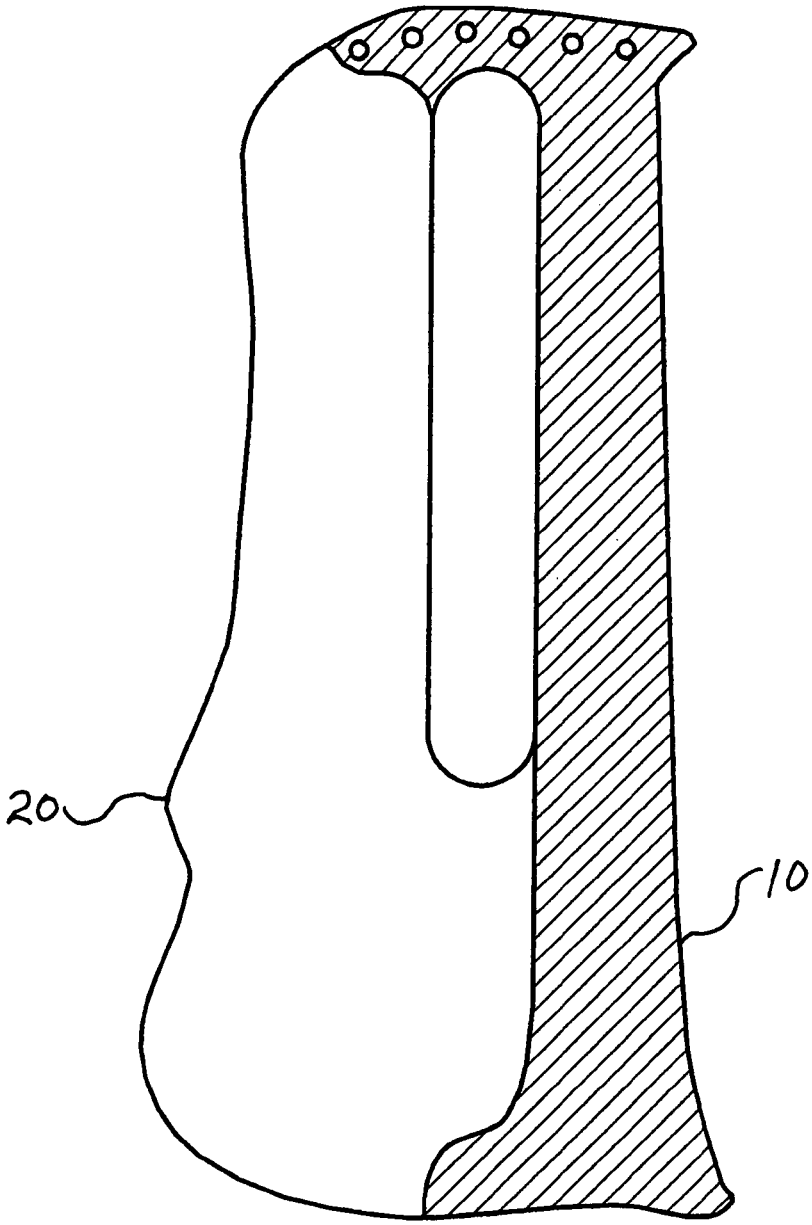
FIG. 5 is a face plan view having a facial surface cut away to show the interior components.
Figure 6:
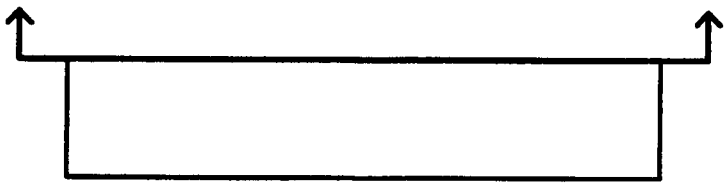
FIG. 6 is a bottom plan view showing the line along which the FIG. 5 facial surface is cut away.

10 Neck
20 Sound Chamber
30 Strings
35 Head
40 Tuning Pegs
50 Nut
60 Bridge
70 String Retaining Pegs
75 Base Referring to FIGS. 1, 2, and 3, the neck (10) and sound chamber (20) are located side-by-side such that when it is in normal playing position, the neck is below the sound chamber. The strings (30) run from the retaining pegs (70) over the bridge (60), along the neck (10), across the nut (50) and thence to the tuning pegs (40) in the head (35).

Figure 4:
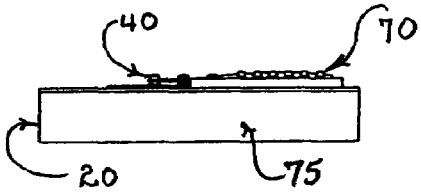
FIG. 4 is a bottom plan view

Referring to FIG. 4, one sees the base (75), viewing the bottom of the sound chamber (20), the retaining pegs (70) and two tuning pegs (40).

The instrument is normally played by holding it in front of one's body with the strings facing outward, away from the body, and the sound chamber uppermost. One's right hand is used to strum or pluck the strings while the left hand is employed holding the instrument by the neck and chording or fingering the strings along the neck. The strings are tuned by turning individual tuning pegs to loosen or tighten each string as required.

The herein taught device, so configured, is convenient to transport and play, and produces a singular, pleasing sound, quite unlike that of a conventional guitar.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A musical instrument comprising:

at least one sound chamber having a face and boundaries, said sound chamber so disposed as to lie in a plane or planes, at least one side, and a length, said sound chamber being essentially hollow, at least one neck, having boundaries and comprising a head and a base, a bridge and nut, wherein the head and the base are located at distal ends of the instrument each from the other, and also comprising at least one neck-face over which one or more strings are mounted, said neck-face and strings or strings disposed and tensioned parallel to each other in planes substantially parallel or conforming to a plane or planes of the face of the sound chamber, said neck configured to lie substantially along one said side and parallel to said length of the sound chamber, but not in front of the face of the sound chamber, nor behind the sound chamber or body, and further configured such that the boundaries of the neck and the boundaries of the sound chamber are adjacent, but do not intersect, the sound chamber being limited to an area or areas alongside the neck, but not under the strings, such that said strings are substantially tensioned only over the neck alone, thereby allowing none of the strings to be tensioned before the face of the sound chamber, nor behind the sound chamber, and further, such that essentially no string tension is absorbed by or supported by the sound chamber or body.

2. An instrument as in claim 1 wherein the neck is connected to the sound chamber in the vicinity of the head, only.

3. An instrument as in claim 1 wherein the neck is connected to the sound chamber in the vicinity of the base, only.

4. An instrument as in claim 1 wherein the neck is connected to the sound chamber in the vicinities of both the head and the base.

5. An instrument as in claim 1 wherein the neck is connected to the sound chamber at a point between the head and the base.

6. An instrument as in claim 1 wherein the neck, bridge and nut are curved across an axis parallel to the neck in such a way as to facilitate bowing the strings.

7. A musical instrument comprising:

one sound chamber having a face and boundaries, said sound chamber so disposed as to lie in a plane or planes, at least one side, and a length, said sound chamber being essentially hollow, one neck, having boundaries and comprising a head and a base, a bridge and nut and also comprising at least one neck-face over which one or more strings are mounted, said neck-face and strings or strings disposed and tensioned parallel to each other in planes substantially parallel or conforming to a plane or planes of the face of the sound chamber, said neck configured to lie substantially along one said side and parallel to said length of the sound chamber, but not in front of the face of the sound chamber or body, nor behind the sound chamber, and further configured such that the boundaries of the neck and the boundaries of the sound chamber are adjacent, but do not intersect, the sound chamber being limited to an area or areas alongside the neck, but not under the strings, such that said strings are substantially tensioned only over the neck alone, thereby allowing none of the strings to be tensioned before the face of the sound chamber, nor behind the sound chamber, and further, such that essentially no string tension is absorbed by or supported by the sound chamber.

8. An instrument as in claim 7 wherein the neck is connected to the sound chamber in the vicinity of the head, only.

9. An instrument as in claim 7 wherein the neck is connected to the sound chamber in the vicinity of the base, only.

10. An instrument as in claim 7 wherein the neck is connected to the sound chamber in the vicinities of both the head and the base.

11. An instrument as in claim 7 wherein the neck is connected to the sound chamber at a point between the head and the base.

12. An instrument as in claim 7 wherein the neck, bridge and nut are curved across an axis parallel to the neck in such a way as to facilitate bowing the strings.

13. A musical instrument comprising:

at least one sound chamber comprising boundaries and a face, said sound chamber so disposed as to lie in a plane or planes, at least one side, and a length, said sound chamber being essentially hollow, at least one neck, having boundaries and comprising a head and a base, a bridge and nut, and also comprising at least one neck-face over which one or more strings are mounted, said neck-face and strings or strings disposed and tensioned parallel to each other in planes substantially parallel to or conforming to a plane or planes of the face of the sound chamber, said neck configured to be substantially confined to lie only along one said side and parallel to said length of the sound chamber, said neck and sound chamber so configured that the boundaries of the neck and the boundaries of the sound chamber are adjacent, but do not intersect, the sound chamber being limited to an area or areas alongside the neck, restricted from any area under the strings, such that essentially all string tension is essentially absorbed by or supported by the neck, and wherein the neck is connected to the sound chamber in the vicinities of both the head and the base.

* * * * *